US006658823B2

(12) United States Patent
Johnsen et al.

(10) Patent No.: US 6,658,823 B2
(45) Date of Patent: Dec. 9, 2003

(54) BAG OPENING AND CLOSING MACHINE

(75) Inventors: Ole Johnsen, Campbellville (CA); Denis Trottier, Burlington (CA)

(73) Assignee: Johnsen Machine Company Limited, Burlington (CA)

( * ) Notice: Subject to any disclaimer, the term of this patent is extended or adjusted under 35 U.S.C. 154(b) by 19 days.

(21) Appl. No.: 10/052,401

(22) Filed: Jan. 23, 2002

(65) Prior Publication Data

US 2003/0136090 A1 Jul. 24, 2003

(51) Int. Cl.[7] ..... B67B 7/00
(52) U.S. Cl. ..... 53/492; 53/384.1
(58) Field of Search ..... 53/459, 492, 570, 53/571, 572, 573, 384.1, 133.4

(56) References Cited

U.S. PATENT DOCUMENTS

| | | | | | |
|---|---|---|---|---|---|
| 3,747,298 | A | * | 7/1973 | Lieberman | 53/390 |
| 3,869,065 | A | * | 3/1975 | Wang | 221/40 |
| 3,896,605 | A | * | 7/1975 | Chevalier | 53/570 |
| 3,903,677 | A | * | 9/1975 | Bowman et al. | 53/381.1 |
| 4,172,349 | A | * | 10/1979 | Lipes | 53/459 |
| 4,301,842 | A | * | 11/1981 | Kuckhermann | 141/114 |
| 4,537,013 | A | * | 8/1985 | Tetenborg et al. | 53/570 |
| 4,676,284 | A | * | 6/1987 | DeCrane | 141/114 |
| 4,700,755 | A | * | 10/1987 | Banys | 141/114 |
| 4,798,042 | A | * | 1/1989 | Davis | 53/572 |
| 5,177,939 | A | * | 1/1993 | Lipes | 53/572 |
| 5,375,396 | A | * | 12/1994 | Huwelmann | 53/502 |
| 5,452,559 | A | * | 9/1995 | Lipes | 53/67 |

FOREIGN PATENT DOCUMENTS

| | | | | |
|---|---|---|---|---|
| DE | 41 05 452 | * | 8/1992 | B65B/43/26 |
| JP | 06122421 | * | 5/1994 | B65B/43/26 |

* cited by examiner

*Primary Examiner*—Rinaldi I. Rada
*Assistant Examiner*—Paul Durand
(74) *Attorney, Agent, or Firm*—Robert F. Delbridge

(57) ABSTRACT

A method of opening and closing a bag having a front and a rear and an opening at the top includes feeding the bag to a machine which holds an upper end of the front of the bag, moves the upper end of the rear of the bag rearwardly to partially open the bag clamps each opposite side of the bag while the bag is in the partially open configuration, and moves the clamped opposite sides of the bag and the rear of the bag rearwardly to a fully open position.

6 Claims, 8 Drawing Sheets

BAG OPENING AND CLOSING MACHINE

FIELD OF INVENTION

This invention relates to bag opening and closing machines, the bags usually but not necessarily being plastic bags.

BACKGROUND OF THE INVENTION

Machines for opening and closing bags are of course well known, see for example U.S. Pat. No. 4,124,966 (Wilson) issued Nov. 14, 1978 and U.S. Pat. No. 4,198,800 (Wilson) issued Apr. 22, 1980, the contents of these patents being hereby incorporated herein by reference. Such machines open plastic bags one at a time, fill the open bag with the necessary contents and then close the bag. However, especially with plastic bags, known machines do not open the bags as effectively as desired.

It is therefore an object of the invention to provide a bag opening and closing machine which has a more effective opening mechanism.

SUMMARY OF INVENTION

According to one aspect of the invention, a method of opening and closing a bag having a front and a rear and an opening at the top includes feeding the bag to a machine which:

a) holds an upper end of the front of the bag, b) moves the upper end of the rear of the bag rearwardly to partially open the bag, c) clamps each opposite side of the bag while the bag is in the partially open configuration, and d) moves the clamped opposite sides of the bag and the rear of the bag rearwardly to a fully open position.

The bag may have a reclosable seal which remains in a closed configuration when the bag has been partially opened and which is opened by a plunger moving into the bag when the bag is being fully opened.

Each side of the body may be clamped by a clamping finger which moves into the bag adjacent the side thereof. Alternatively, each side of the body may be clamped between clamping jaws outside the bag.

According to another aspect of the invention, a bag opening and closing machine for bags having a front and rear and an opening at the top has:

a holder for holding an upper end of the front of the bag, means for moving an upper end of the rear of the bag rearwardly to partially open the bag, means for clamping each opposite side of the bag while the bag is in the partially open configuration, and means for moving the clamped sides of the bag and the front of the bag rearwardly to a fully open position.

DESCRIPTION OF THE DRAWINGS

Embodiments of the invention will now be described, by way of example, with reference to the accompanying drawings, of which.

DESCRIPTION OF THE PREFERRED EMBODIMENTS

Figure 1:
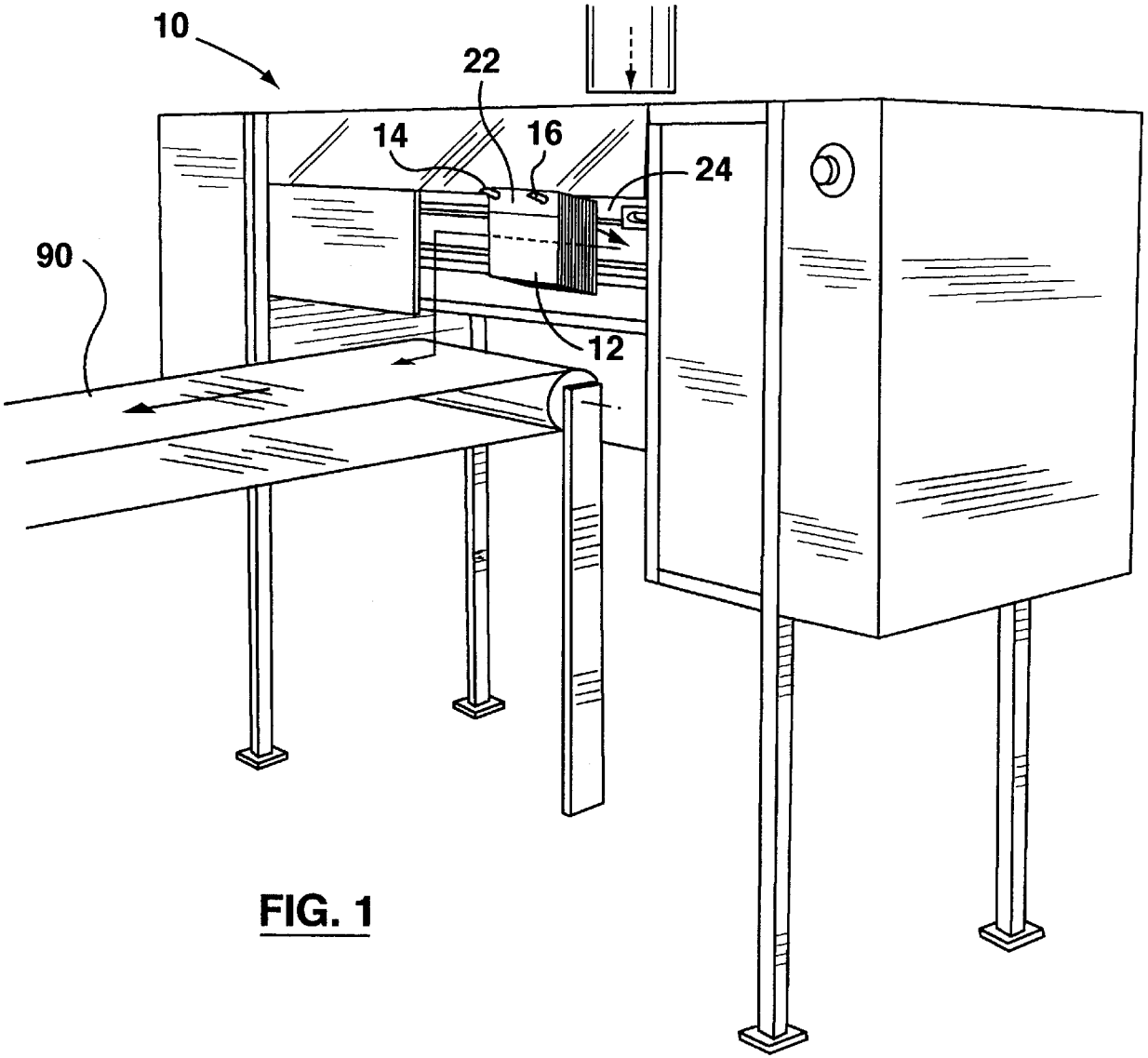
FIG. 1 is a perspective view from the front of a bag opening and closing machine in accordance with one embodiment of the invention.
Figure 2:
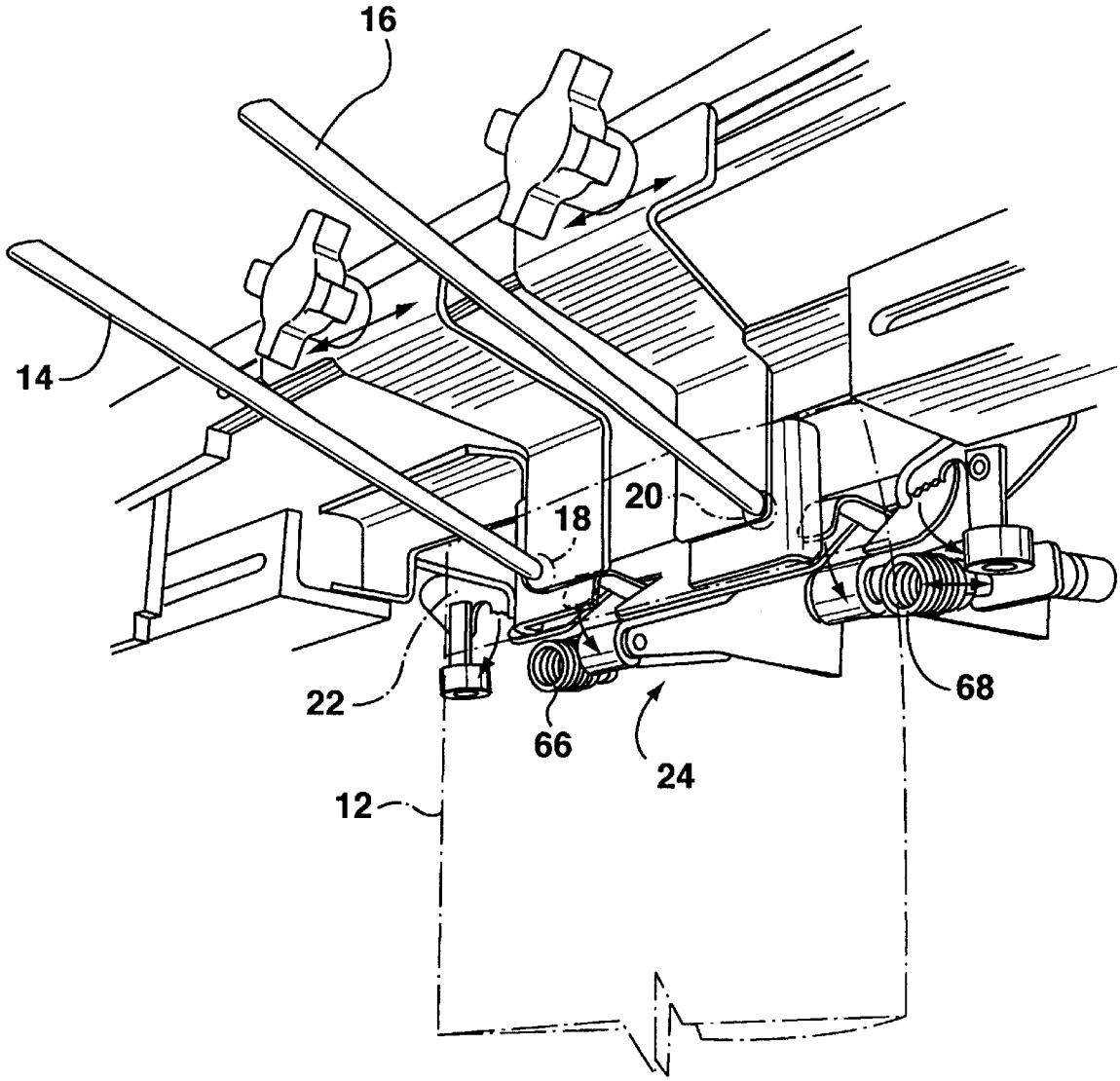
FIG. 2 is an enlarged perspective view of the portion of the machine where a supply of bags to be opened are hung, with one bag being shown in dotted outline.

Referring to the drawings, the upper bag opening and closing machine has a supply of plastic bags 12 to be filled hung one behind the other on forwardly extending bag receiving rods 14, 16 which pass through laterally spaced apertures 18, 20 in a flap 22 extending upwardly from the front of the bag 12. The receiving rods 14, 16 are upwardly inclined so that the bags 12 slide rearwardly down the rods 14, 16. A carriage 24 is mounted on a pair of laterally spaced and rearwardly extending rails 26, 28, and the rails 26, 28 are mounted at the front and rear on laterally extending rails 30, 32 so that the carriage 24 can be moved laterally.

The carriage 24 has a front portion 36 which is fixed on the rails 26, 28 and laterally spaced middle portions 38, 39 and a rear portion 40 which are movable in a rearward direction. The middle portions 38, 39 are connected to the front portion 36 by transversely spaced links 42, 44 respectively whose opposite ends are pivotally connected to the front portion 36 and the respective middle portion 38, 39. The links 42, 44 are laterally, outwardly and rearwardly inclined. The rear portion 40 is connected to the middle portions 38, 39 by two laterally spaced pairs of links 46, 48 and 50, 52 respectively. The opposite ends are pivotally connected to the rear portion 40 and respective middle portions 38, 39. The links 46, 48 are laterally inwardly and rearwardly inclined, as also are the links 50, 52.

The middle portion 38 of the carriage 24 carries a side clamping assembly which includes a side clamping finger 58 which is movable between inoperative and operative positions by a pneumatic cylinder 60. Likewise, the middle portion 39 carries a side clamping finger 62 operable by a pneumatic cylinder 64. The rear portion 40 carries a pair of laterally spaced longitudinally movable suction cups 66, 68 operable by pneumatic cylinders 70, 72 respectively and also carries a pair of laterally spaced rear clamping fingers 76, 78 movable between inoperative and operative positions by pneumatic cylinders 80, 82 respectively. The rear portion

40 also carries a plunger 84 movable between upper and lower positions by a pneumatic cylinder 86.

The operation of the above described mechanism will now be explained. The manner in which the various moving parts are controlled will be readily apparent to a person skilled in the art on the foregoing and following description.

Figure 3:
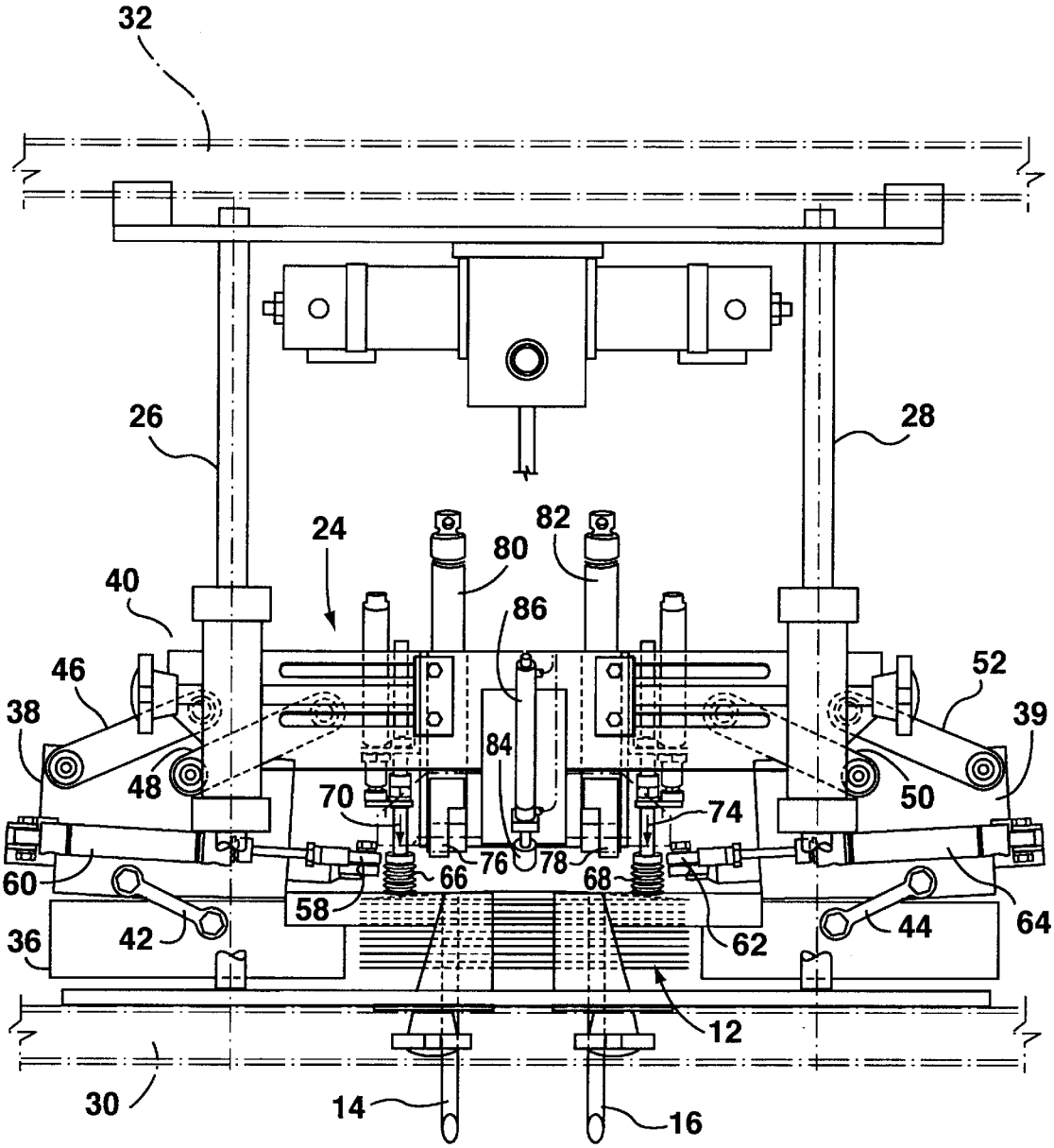
FIG. 3 is a planned view of the machine with the suction cups in a forward position engaging the rear of a bag to be opened.
Figure 4:
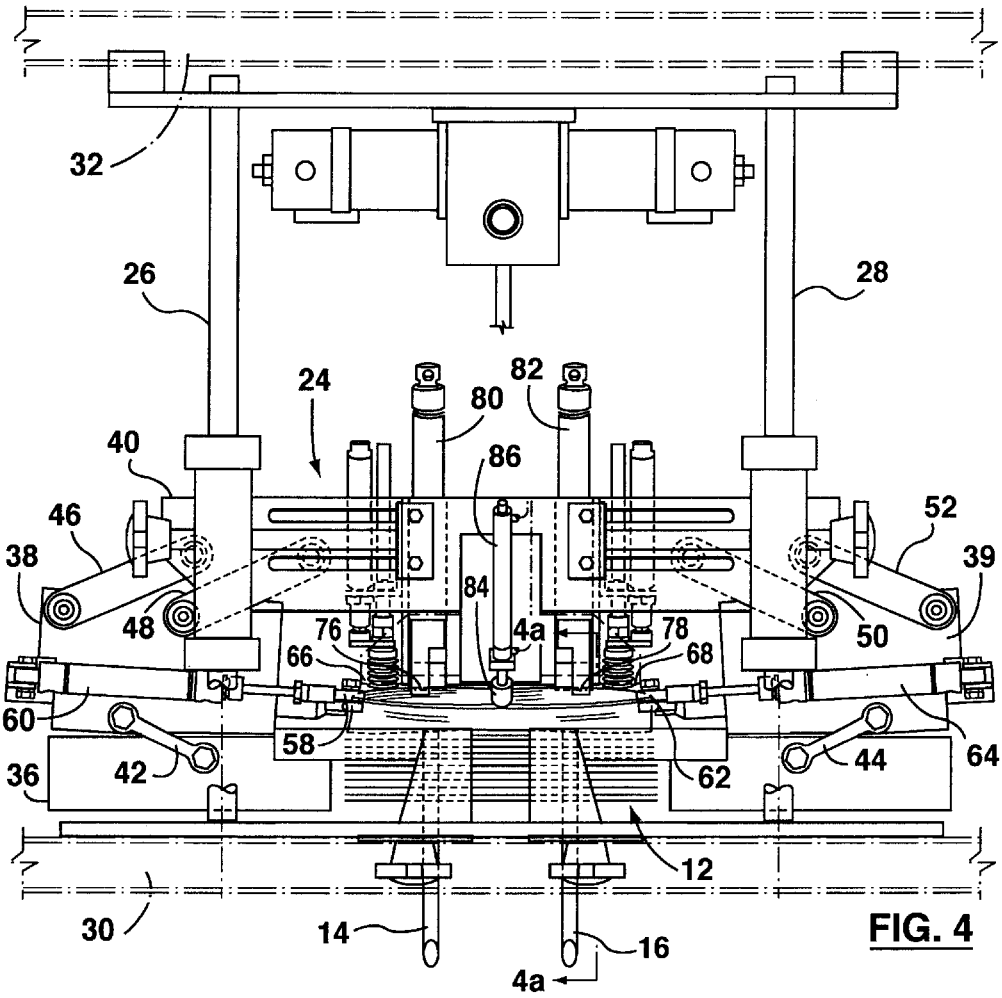
FIG. 4 is a similar view but with the suction cups having been moved rearwardly to slightly open the upper portion of the bag, with the rear clamps holding the upper edge portion of the rear of the bag in an initial rearward position, and with the side clamps holding the sides of the bag in laterally spaced positions.
Figure 4A:
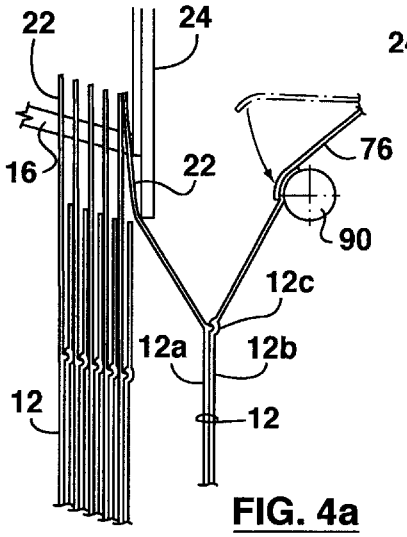
FIG. 4*a* is an enlarged somewhat diagrammatic side view taken along the line 4*a*—4*a* of FIG. 4 showing the slightly open configuration of the bag.

Referring to FIG. 3, the suction cups 66, 68 are moved forwardly by extension of the pneumatic cylinders 70, 72 and activated to cause them to engage the upper part of the rear of the rearmost bag 12 of the supply thereof mounted on bag receiving rods 14, 16, suction cups 66, 68 engaging the rear portion 12*b* of the bag 12 near the upper edge thereof. As shown in FIG. 4, the pneumatic cylinders 70, 72 are then contracted to pull the upper edge portion of the back of the bag 12 rearwardly to slightly open the top of the bag, with the upperly extending flap 22 on the front of bag remaining in position on the receiving rods 14, 16. The rear gripping fingers 76, 78 are then actuated by extension of pneumatic cylinders 80, 82 so that the rear clamping fingers 76, 78 extend into the upper end of the bag and clamp the upper edge portion of the back 12*b* of the bag between the rear gripping fingers 76, 78 and a stop member 90 (see FIG. 4*a*). The top portion of the bag above a reclosable seal 12*c* is then open.

Figure 4B:
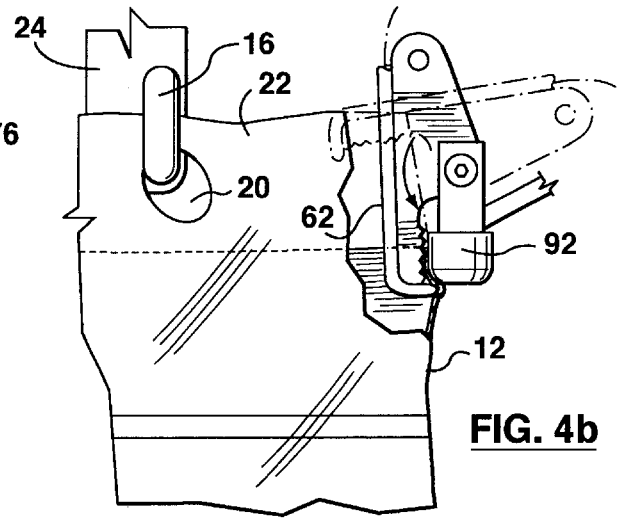
FIG. 4*b* is an enlarged somewhat diagrammatic front view of one of the side clamps and associated portion of the bag.

The side gripping fingers 58, 62 are then actuated by extension of the pneumatic cylinders 60, 64 so that the side clamping fingers 58, 62 enter into the bag 12 on opposite sides thereof and clamp the respective side of the bag 12 against a stationary stop 92 (see FIG. 4*b*).

Figure 5:
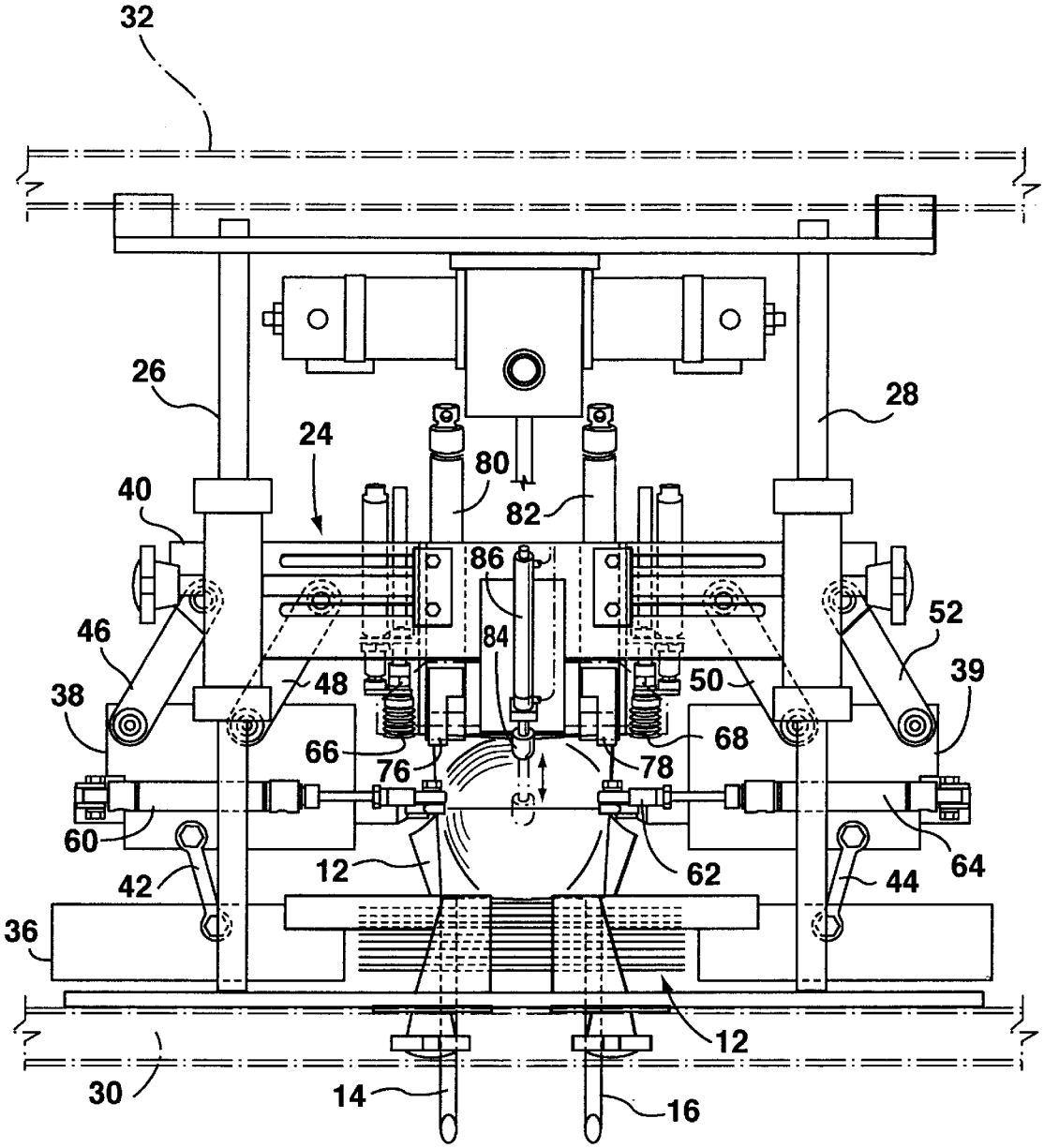
FIG. 5 is a similar view to FIG. 4 but with the rear clamps having been moved rearwardly to more fully open the upper portion of the bag and the plunger having been moved downwardly to open the zip and the lower portion of the bag.

Referring now to FIG. 5, the suction cups 66, 68 are then de-actuated and the rear portion 40 and middle portions 38, 39 of the carriage 24 are moved rearwardly. At the same time, the plunger 84 is moved downwardly into the bag 12 to open the reclosable seal 12*c* and the bag 12 is therefore now completely open. The open bag is then filled by means of a filling mechanism (not shown), the nature of which will again be readily apparent to a person skilled in the art.

Figure 6:
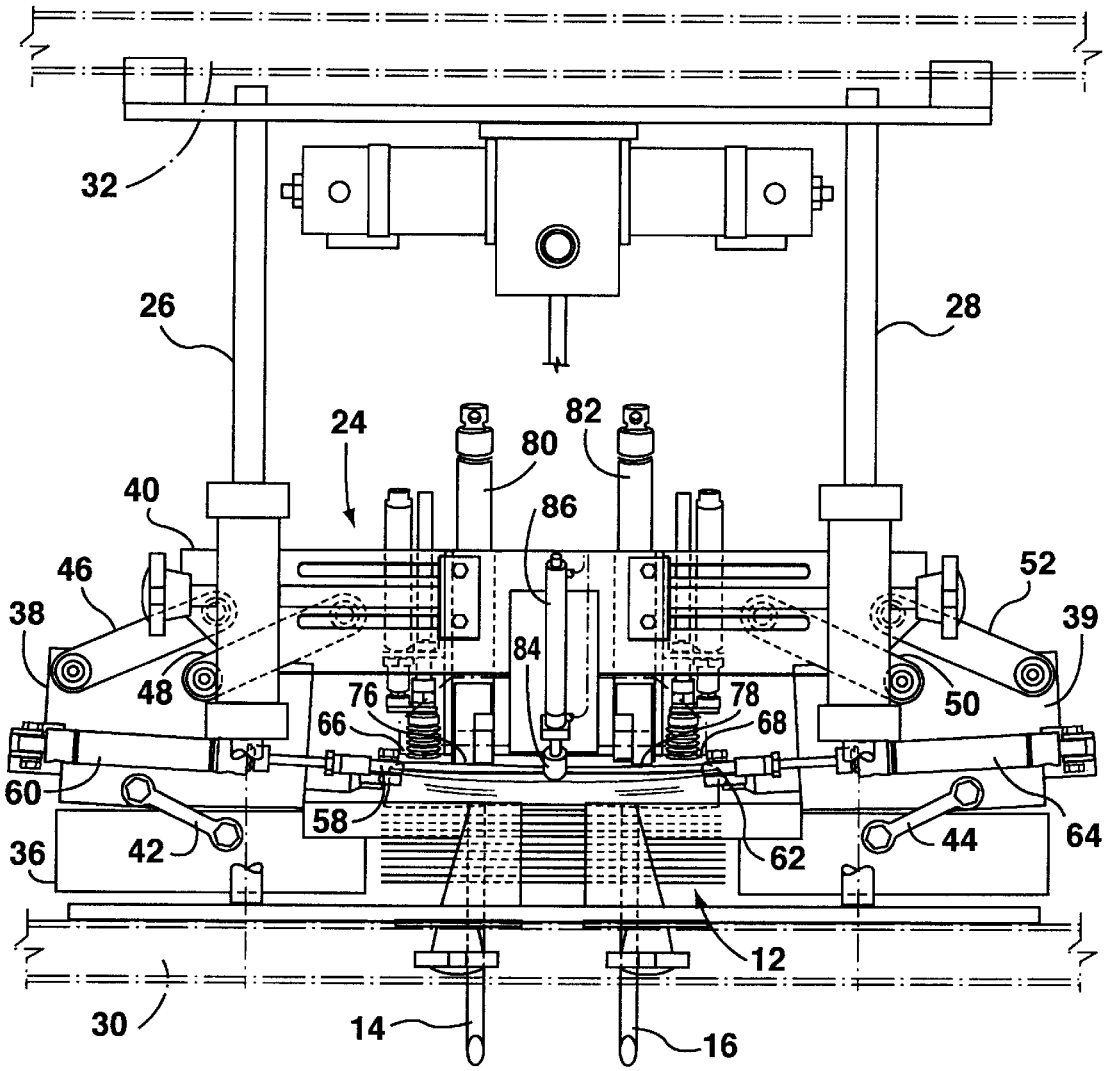
FIG. 6 is a similar view but with the rear clamps having been moved forwardly after filling of the bag, to nearly close the upper portion of the bag.

Referring now to FIG. 6, the rear portion 40 and middle portions 38, 39 are then moved forwardly to their original positions (as shown in FIGS. 3 and 4). At the same time, pneumatic cylinders 80, 82 are actuated to release the rear clamping fingers 76, 78 from the front of the bag. Thus, at this stage, the filled bag is nearly closed, with the side clamping fingers 58, 62 still in the clamping configuration and with the upwardly extending flap 22 still mounted on the receiving rods 14, 16. A conventional closing mechanism (not shown) moves laterally across the top of the bag, the pneumatic cylinders 60, 64 are then de-actuated to release the side clamping fingers 58, 62 from the filled bag, and the closing mechanism then closes the bag. The carriage 24 then moves to the left, tearing the bag 12 away from the flap 22 in known manner, and discharges the filled and closed bag onto a conveyor 90 as indicated in FIG. 1.

As will be particularly evident from FIG. 6, (and also FIGS. 3 and 4), the middle portions 38, 39 of the carriage 24 and also the pneumatic cylinders 60, 64 are skewed slightly laterally inwardly and forwardly by a small angle so that, when the carriage 24 is in the forward position, the side clamping fingers 58, 62 are in a forward position which is as close as practically possible to the front of the bag so that the upper end of the bag is only open a small amount.

Figure 7:
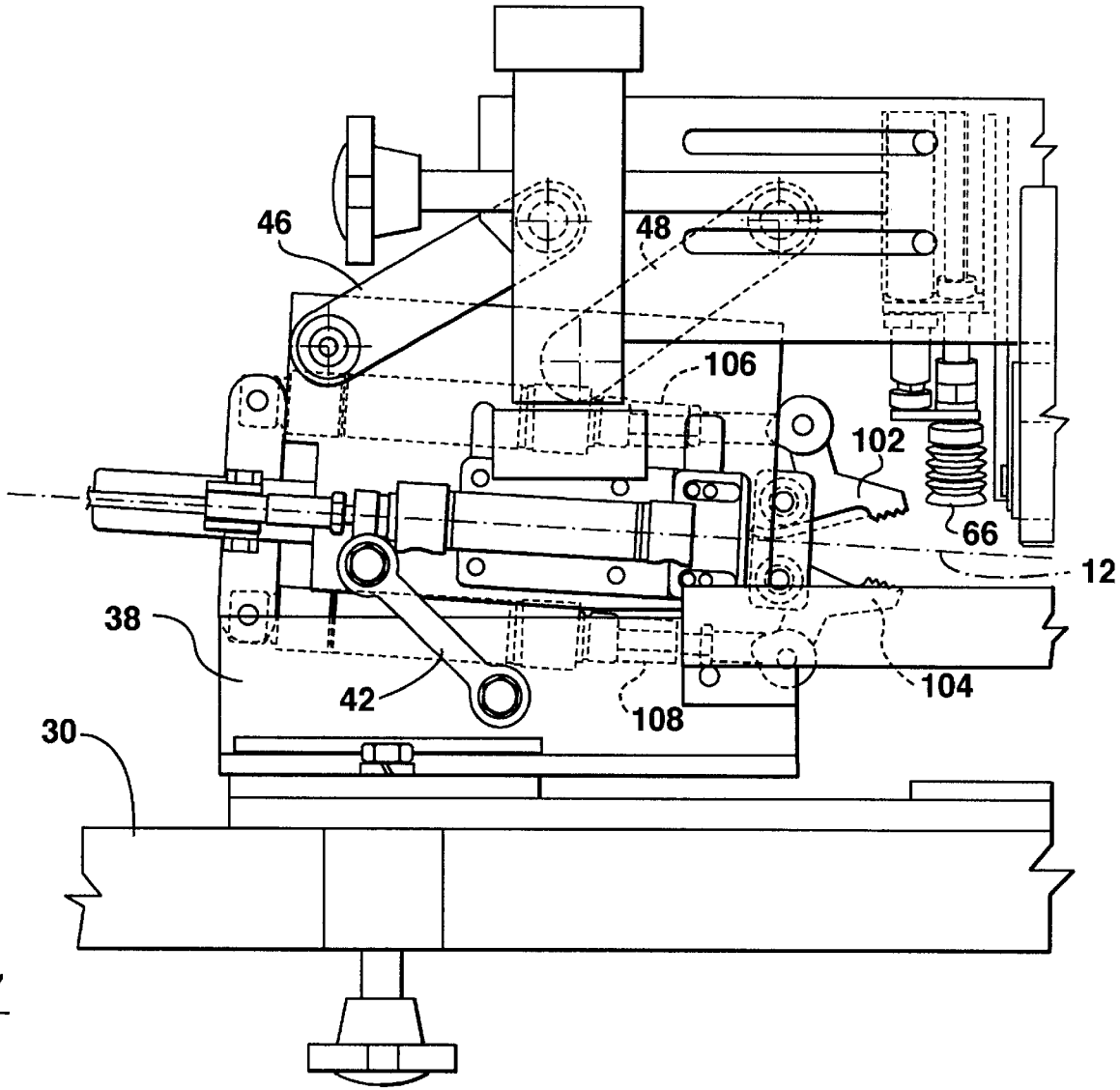
FIG. 7 is a planned view of a portion of the machine showing an alternative side clamping assembly with the jaws thereof in the open position.
Figure 8:
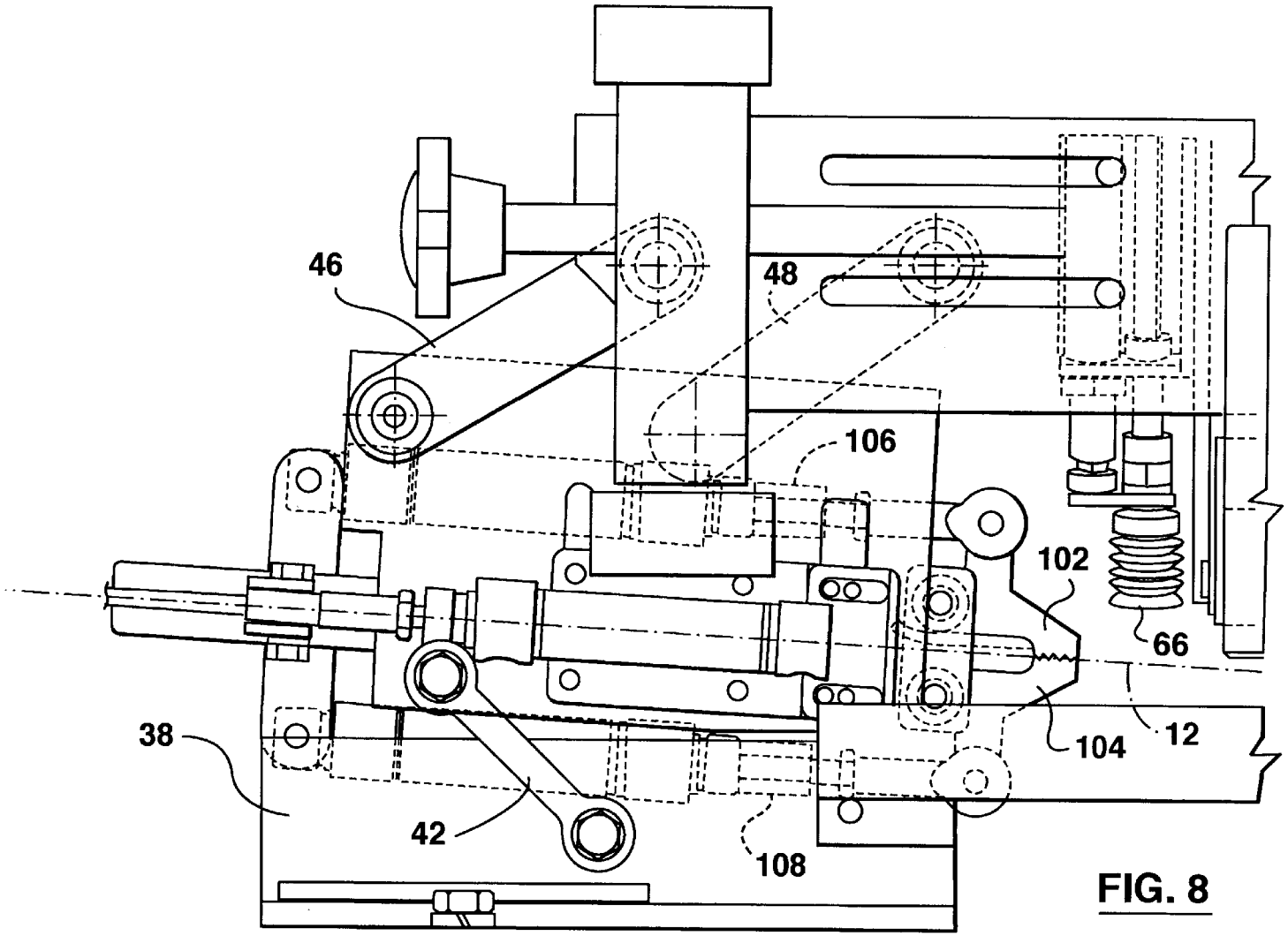
FIG. 8 is similar to FIG. 7 but showing the jaws in the closed position.

In the above described embodiment, the side clamping assembly included clamping fingers which moved into the interior of the bag. For bags with wide side edge seams, as shown in FIGS. 7 and 8, the side clamping assembly may include openable and closeable jaws 102, 104 operable by pneumatic cylinders 106, 108 respectively to grip the sides of the bag in pincer-like fashion.

It should be noted that the bag may not necessarily be provided with a reclosable seal 12*c*, but only with closure provided by the previously mentioned closing mechanism.

The advantages of the invention and other embodiments thereof will now be readily apparent to a person skilled in the art from the foregoing description of preferred embodiments, the scope of the invention being defined in the appended claims.

What is claimed is:

1. A method of opening a bag having a front and a rear and an opening at the top, said method including feeding the bag to a machine which:

a) holds an upper end of the front of the bag, b) moves the upper end of the rear of the bag rearwardly to partially open the bag, c) clamps each opposite side of the bag while the bag is in the partially open configuration, and d) moves the clamped opposite sides of the bag and the rear of the bag rearwardly to a fully open position, the bag having a reclosable seal which remains in a closed configuration when the bag has been partially opened and which is opened by a plunger moving into the bag when the bag is being fully opened.

2. A method according to claim 1 wherein each side of the bag is clamped by a clamping finger which moves into the bag adjacent the side thereof.

3. A method according to claim 1 wherein each side of the bag is clamped between clamping jaws outside the bag.

4. A bag opening machine for bags having a front and a rear and an opening at the top, said machine having:

a holder for holding an upper end of the front of the bag, means for moving an upper end of the rear of the bag rearwardly to partially open the bag, means for clamping each opposite side of the bag while the bag is in the partially open configuration, means for moving the clamped sides of the bag and the rear of the bag rearwardly to a fully open position, and a plunger operable to enter the bag when the bag is being fully opened to open a reclosable seal which has remained closed when the bag was being partially opened.

5. A bag opening machine according to claim 4 wherein the clamping means includes clamping fingers which move into the bag adjacent the sides thereof.

6. A bag opening machine according to claim 5 wherein the clamping means includes clamping jaws externally of the bag which clamp the sides thereof there between.

* * * * *